United States Patent [19]

Klebl et al.

[11] Patent Number: 4,629,522

[45] Date of Patent: Dec. 16, 1986

[54] SEALING COMMUNICATION CABLE

[75] Inventors: Wolfram Klebl, Isernhagen; Karl-Heinz Marx, Garbsen; Arnold Vogts, Isernhagen; Friedrich Schatz; Guenter Titze, both of Langenhagen, all of Fed. Rep. of Germany

[73] Assignee: Kabelmetal Electro GmbH, Hanover, Fed. Rep. of Germany

[21] Appl. No.: 745,411

[22] Filed: Jun. 14, 1985

[30] Foreign Application Priority Data

Jun. 14, 1984 [DE] Fed. Rep. of Germany ..... 3422020

[51] Int. Cl.[4] ..... H01B 13/32

[52] U.S. Cl. ..... 156/48; 156/244.12; 156/500; 264/262; 264/323; 425/143

[58] Field of Search ..... 156/48, 244.11, 500, 156/244.12; 264/323, 25, 27, 262; 72/273; 425/174, 174.6, 143

[56] References Cited

U.S. PATENT DOCUMENTS 2,109,822 3/1938 Eddy ..... 425/174.6
2,659,132 11/1953 Leontis et al. ..... 264/323 X
3,733,225 5/1973 Moody ..... 156/48

FOREIGN PATENT DOCUMENTS 2405784 8/1975 Fed. Rep. of Germany .
2614806 10/1977 Fed. Rep. of Germany .

*Primary Examiner*—Robert A. Dawson
*Attorney, Agent, or Firm*—Ralf H. Siegemund

[57] ABSTRACT

A viscous sealing material is applied to a communications cable by being forced out of a container by means of a heatable pressure plate having a bore and a pump adjacent to the bore; the sealing material is conveyed by the pump through a conduit to a chamber, in which the sealing material is introduced under pressure into and around an already stranded cable core; the pressure plate includes a plurality of preferably helically coil electrical heating elements separated from each other and projecting therefrom for penetrating into the sealing material in the container when the pressure plate applies pressure to the sealing material so that it is progressively liquified and can be pumped out of the container.

5 Claims, 3 Drawing Figures

SEALING COMMUNICATION CABLE

BACKGROUND OF THE INVENTION

The present invention relates to the manufacture of communication cable such that the cable is sealed against longitudinal migration of water, inside the cable which contains a core and/or conductors that are being electrically insulated by means of a synthetic. Cable of the type to which the invention pertains has usually an assembly of a core being comprised of several conductors, and a sheathing or jacket is arranged around that core while any spaces in between are filled with a sealer. For making such sealed cable one proceeds usually in that the sealing material is forced under pressure in and around the completely stranded cable core under utilization of a pressurized arrangement, for forcing highly viscous sealing material out of a container and through a heatable pressure plate whereby the pressure force is provided through a tube being attached to that plate to provide for the transmission of the requisite pressure force. The plate has a bore being aligned with the axial bore of the tube, and the bore in the plate or the tube includes a pump arranged on the other side with the chamber. The sealing material is thus forced out of the container through the tube.

Generally speaking filling the cavity in and around a cable core, and between the cable core and the jacket in communication cables, by means of a sealing material serves the purpose of avoiding migration of water that may have entered the cable at some point in longitudinal direction. Even though the cable core is insulated electrically, longitudinal migration of water is still to be avoided because the water may find a weak point for example in a connecting sleeve or the like and produce some sort of short circuit. Moreover it was found that a cable into which water has seeped and migrated in the interior for any length thereof deteriorates as to its electrical properties generally.

Devices have been proposed by means of which such a cable is to sealed. As a sealing material, properly termed as a filler, one can use a vaseline-like pasty material being highly viscous at room or normal operating temperature while permitting more or less easy flow and a high rate of fluidity when heated. The temperature dependency of the physical state of the filler requires it to liquify more or less prior to the insertion into the cable or cable core. For a long cable, or one may say for cables to be manufactured in an endless configuration, one needs considerable amounts of energy and equipment just for purposes of liquifying the sealing and filling material.

It is a customary procedure to heat the filler and sealer through an open gas flame, the material being in a suitable container or one uses indirect heating through the container wall. Either procedure is either time consuming and one obtains more or less melting or high degree of liquification in and around the container wall while the center of the container content does not melt at all or only very little. The filler material envisioned here is a rather poor heat conductor. If the entire content of the container is to be melted which is normally to be expected, one must expect for reasons of inadequate convection flow that outer parts of the filling material are overheated. If applied now without any attempt to render the temperature more or less uniform it may well be that certain parts of the filler when applied to the cable are in fact too hot and that may require subsequent cooling.

German Pat. No. 2,405,784 proposes a device wherein as outlined in the introduction herein the basically cold filler is forced under very high pressure out of the container and passes through a flash heater for heating to assume the desired operating temperature. It is not expected to pose any problems that one needs considerable pressure but it is quite possible that when the pressure is too high the container ruptures and that renders temporarily the entire device inoperative. Another problem that was observed is that in the filling material certain air pockets are trapped and remain in the material.

A device still closer to the arrangement alluded to in the introduction is disclosed in German printed application No. 2,614,806. Herein heating elements are provided and completely embedded in the pressure plate which pressure plate has a smooth surface where facing the filler. The heat as developed in the heating elements will therefore not directly affect the filler but the pressure plate has to be heated first. It was found that this indirect heating requires extensive amounts of energy. Moreover, a rapid action response type of any control of the temperature of the heating element is not possible because the large mass of the pressure plate responds very sluggishly to any temperature change. For reduced pump volume or even in case of a stoppage of the entire equipment the filling material again may be overheated just because of the slow response of the temperature control.

DESCRIPTION OF THE INVENTION

It is an object of the present invention to provide a new and improved apparatus, device and equipment for forcing filler and sealer material to be used in comminucation cables out of a container under utilization of a heated pressure plate in which however the high energy expenditure of prior art devices for producing the requisite heat is kept lower and which permits faster response in the control of the temperature of the heating process including particularly the pressure plate as well as the filling material itself.

In accordance with the preferred embodiment of the present invention it is suggested to provide a pressure plate with a plurality of heating elements which are spatially separated from each other but project from the surface of the pressure plate facing the sealing material for penetrating into the sealing material to be pressurized, so that the sealing material is directly exposed, not just on its surface but also in its interior.

Therefore the device in accordance with the invention provides heating elements indirect contact with the filling material whenever the pressure plate is in the operating state in the container for the sealing material. Since the elements penetrate the filling and sealing material, not just the pressure plate but the filling material itself is heated. This direct transfer of thermal energy into the filling material drastically reduces the requirement of thermal energy for the operation of forcing the material out of the container in a fluid-like flow. Also, any temperature change of the heating elements is immediate and directly effective at and in the filling material so that a fast response type temperature control becomes available. This feature is particularly of advantage if for some reason the entire device is down, as now excessive heating of filling material can be avoided simply through appropriate quick response follower action by the temprature control. The same aspect obtains if the pump operates at a reduced volume.

It was found that the efficiency of the device is most favorable if the particular portions in the heating elements which actually generate heat are in fact completely outside of the preiphery of the pressure plate. In furtherance of the invention it is suggested to provide the projecting part of the heating elements in helically coiled form to further increase the area of filler material available for heating.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following desription taken in connection with the accompaning drawings in which:

Figure 1:
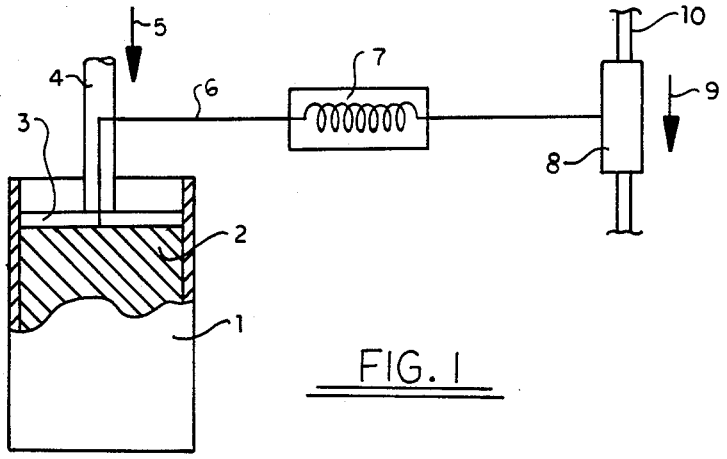
FIG. 1 is a somewhat schematic view of a device constructed in accordance with the preferred embodiment of the present invention for practicing the best mode thereof.
Figure 2:
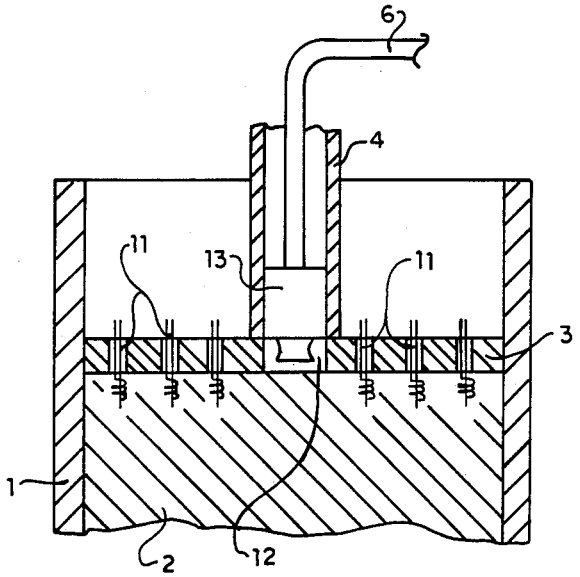
FIG. 2 illustrates relevant portion of the device shown in FIG. 1 in an enlarged scale and showing heating process and equipment for filling material.

Proceeding now to the detailed description of the drawings reference numeral 1 refers to a vessel or a container such as a barrel or the like in which normally a highly viscous material 2 is contained. A pressure plate 3 sits on the surface of the filling or sealing material 2 contained in the vessel 1, and the side of the plate 3 facing away from the filling material is affixed to a tube 2. A pressure force can be applied to this particular plunger arrangement the pressure being schematically indicated by the arrow 5.

A conduit runs from the pressure plate 3 and actually through the tube 4 to a schematically indicated flash heater 7 having its other end or output side connected to a chamber 8 being passed through on a continuous basis by a cable core 10; the direction of cable core movement is indicated by arrow 9. Liquified filling material 2 is applied to that core and around the core; this mode of applicaiton being conventional and therefore not illustrated in detail.

In order to reduce the viscosity of the filling material 2, i.e. in order to more or less liquify the material 2 being in an almost solid state heating must be provided so as to permit extraction of the filling material to container 1. For this, a plurality of electrical heating elements 11 is provided in the pressure plate 3. The configuration and detailed arrangement of the heating elements is discernable from the enlarged illustration of FIG. 3.

The pressure plate 3 is centrally provided with an opening 12 being in line or aligned with the hollow interior of the tube 4. This area i.e. the bore 12 itself or the interior of the tube right at that point is occupied by a pump 13 facing the interior of the vessel 1 containing the material 2 while having its other end or side connected to the tube line or conduit 6.

In operation it is desirable to remove filling material 2 from the container 1 and apply it for filling the cable core 10. This means that after the pressure plate has been introduced into the vessel 1 the heating elements 11 are turned on. The heating elements 11 directly project into the top surface region of the filling material 2. That surface layer or stratum of the filling material is thus immediately and directly heated; its viscosity is lowered i.e. the material 2 becomes more or less liquified so that the pump, having been turned on, will suck the low viscosity material from the top of the container 1 and feed it into the pipe 6 to pass through the flash heater 7 for further liquification and permitting application by and in the chamber 8. If the temperature of the heating element 11 is controlled to a sufficiently high level the flash heater may actually not be needed so that the filling material is directly fed by the pump 13 to the application chamber 8.

It can thus be seen that upon lowering the pressure plate under influence of the force 5 the respective top layer of the material 2 is continuously liquified and sucked out of the system under operation of the pump 13. The sucking by the pump is of course enhanced and supported by the pressure as applied to the filling material 2 through the pressure plate 3, and the pressure forces the heating elements prospectively into fresh material 2.

Figure 3:
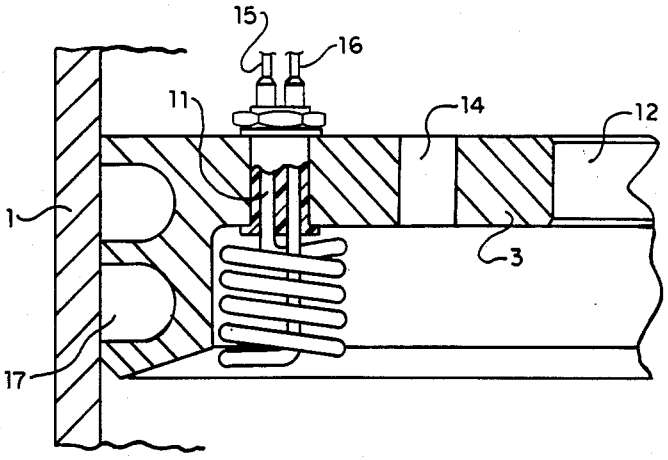
FIG. 3 in turn is a portion of FIG. 2 and on a still further enlarged scale.

The pressure plate 3 has provided on its periphery for example about 30 heating elements 11. These elements 11 are disposed in bores 14 of the pressure plate 3 and anchored thereto through bolting or application of screws. The bores 14 are preferably arranged along two concentric circles. FIG. 3 shows just two of the bores 14, one of them being empty the other one being occupied by a heating element 11.

In accordance with the preferred embodiment of the invention each heating element is constructed as a helically coiled heating spiral. This kind of heating element establishes a very large surface area of contact with the material to be heated so that the heating elements cover more or less the entire surface of the plate 3 and of the adjacent filling material 2. The heating elements 11 preferably provide active generation of thermal energy only in those parts which actually project from the pressure plate 3. As indicated schematically by connections 15 and 16 all of the heating elements 11 are connected to a suitable source of voltage potential. In order to seal the pressure plate 3 against the container wall, the plate may have peripherally arranged grooves 17 for receiving sealing elements, which of course must not be liquified.

It was found that these heating elements 11 as provided in the pressure plate rapidly heat the filling material 2 to about 150 degrees centigrade for a vaseline-like substance. The requisite power depends of course on the amount of material contained in the container 1; that power requirement may be for example 30 kw. The temperature of the filling material 2 may best be measured on the output side of the pump 13 and the measuring value is compared with a reference value. This difference is then used for feedback control purposes.

Since there is a direct and immediate contact between heating elements and the filling material 2 the temperature of the liquified material right at the heating process is rapidly adaptable to any change in the heating conditions. This is not only true for running operation but as well during down times or in case the operation is reduced as to volume.

The invention is not limited to the embodiments described above but all changes and modifications thereof not constituting departures from the spirit and scope of the invention are intended to be included.

We claim:

1. Apparatus for producing a longitudinally watertight communications cable with plastics-insulated conductors, in which cable the cavities of the cable core are filled with a sealing material, including a chamber in which the sealing material is introduced under pressure into and around an already-stranded cable core, and also including a container filled with the sealing material, there being a pressure plate for applying pressure to the sealing material in the container, there being a bore in the plate and a pump in or in the vicinity of the bore, and conduit means for feeding material when liquified to the chamber, the improvement comprising:

a plurality of electrical heating elements in the plate separated from each other and projecting therefrom for penetrating into the sealing material in the container when the plate applies pressure to the material so that the viscosity thereof is lowered.

2. The apparatus as in claim 1, the heating elements provided for active heating only to the extent they project from the plate.

3. The apparatus as in claim 1, said heating elements being of helically coiled configuration.

4. The apparatus as in claim 1, the temperature of the heating elements being controllable as a function of the rate at which sealing material is conveyed by the pump.

5. In a method of forcing a normally highly viscous sealing material into the cavities of a communications cable, wherein the sealing material being located in a container is pressurized and heated to lower its viscosity, and pumped out of the container for delivery to a chamber for application to the cable, the method comprising:

progressively heating the sealing material by means of electrical heating elements projecting from a pressure plate so as to penetrate into the highly viscous sealing material so that heating is effective in the interior thereof, and pumping the liquified sealing material out of the container to the chamber through a tube.

* * * * *